US006223780B1

(12) United States Patent
Kaldenhoff

(10) Patent No.: US 6,223,780 B1
(45) Date of Patent: May 1, 2001

(54) TEXTILE PLANAR STRUCTURE HAVING MACHINE AND CROSS-MACHINE DIRECTION BINDING YARNS

(75) Inventor: Ralf Kaldenhoff, Aachen (DE)

(73) Assignee: Thomas Josef Heimbach Gesellschaft mit beschrankter Haftung & Co. (DE)

( * ) Notice: Subject to any disclaimer, the term of this patent is extended or adjusted under 35 U.S.C. 154(b) by 0 days.

(21) Appl. No.: 09/438,298

(22) Filed: Nov. 12, 1999

(51) Int. Cl.[7] ..... D03D 11/00; D21F 1/00
(52) U.S. Cl. ..... 139/383 A; 442/206
(58) Field of Search ..... 442/206; 139/383 A

(56) References Cited

U.S. PATENT DOCUMENTS

| | | | | |
|---|---|---|---|---|
| Re. 35,777 | | 4/1998 | Givin | 139/383 |
| 4,501,303 | | 2/1985 | Osterberg | 139/425 |
| 4,554,953 | * | 11/1985 | Borel et al. | 139/383 A |
| 4,605,585 | | 8/1986 | Johansson | 428/224 |
| 4,729,412 | | 3/1988 | Bugge | 139/383 |
| 4,815,499 | | 3/1989 | Johnson | 139/383 |
| 4,987,929 | * | 1/1991 | Wilson | 139/383 A |
| 5,152,326 | * | 10/1992 | Vohringer | 139/383 A |
| 5,219,004 | * | 6/1993 | Chiu | 139/383 A |
| 5,244,543 | | 9/1993 | Fry | 162/358 |
| 5,518,042 | | 5/1996 | Wilson | 139/383 |
| 5,564,475 | | 10/1996 | Wright | 139/383 |
| 5,709,250 | | 1/1998 | Ward et al. | 139/383 |
| 5,713,396 | * | 2/1998 | Lee | 139/383 A |
| 5,826,627 | * | 10/1998 | Seabrook et al. | 139/383 A |
| 5,967,195 | * | 10/1999 | Ward | 139/383 A |

FOREIGN PATENT DOCUMENTS

| | | |
|---|---|---|
| 3301810 | 8/1984 | (DE) . |
| 3411119 | 10/1985 | (DE) . |
| 4229828 | 3/1994 | (DE) . |
| 0156314 | 10/1985 | (EP) . |
| 0164434 | 12/1985 | (EP) . |
| 0224276 | 6/1987 | (EP) . |
| 0408849 | 1/1991 | (EP) . |
| 0432413 | 6/1991 | (EP) . |
| 0579818 | 1/1994 | (EP) . |
| 0702108 | 3/1996 | (EP) . |
| 0794283 | 9/1997 | (EP) . |

OTHER PUBLICATIONS

Pp. 84, 85 and 86 of a Japanese book, Published in 1995.*

* cited by examiner

*Primary Examiner*—Andy Falik
(74) *Attorney, Agent, or Firm*—Liniak, Berenato, Longacre & White, LLC

(57) ABSTRACT

A textile planar structure for paper machine cloths, transport belts or filtering means has two or more plies, each of which has structural yarns in both the machine and cross-machine directions that bind at least two plies together, and optionally, structural yarns which do not bind the plies together, but which cooperate with the binding structural yarns to form a uniform weave pattern. At least one ply has a group of adjacent structural yarns running in the same direction that alternate in their position within the planar structure, such that when one yarn binds one ply, another yarn in the same group binds another ply, and vice versa. When a binding structural yarn from an adjacently disposed group crosses from a first ply into an inter-ply space between the plies, another yarn from the same adjacently disposed group crosses from a second ply into the inter-ply space without the binding structural yarns laying under or over each other.

19 Claims, 3 Drawing Sheets

TEXTILE PLANAR STRUCTURE HAVING MACHINE AND CROSS-MACHINE DIRECTION BINDING YARNS

The invention concerns a textile planar structure as or for paper machine cloths, transport belts, or filtering means, having at least two textile plies of which at least one textile ply is a fabric ply having first structural yarns that run in one direction and having second structural yarns that run transversely thereto, groups of respectively adjacent first structural yarns binding, as binding structural yarns, into at least two textile plies in such a way that in at least one textile ply—and preferably in all textile plies that they join—they alternate when viewed in their extension direction.

BACKGROUND

The existing art has disclosed textile planar structures that are formed from two or more textile plies, arranged one above another and constituted as fabric plies, that fundamentally represent independent woven structures. It is characteristic of these that each fabric ply has intersecting mutually interwoven structural yarns, i.e. first structural yarns, for example warp yarns, and second structural yarns transversely thereto, for example weft yarns. Fabrics of this kind are used, in particular, as forming fabric in the sheet-forming region of a papermaking machine. They are theoretically also suitable, however, for being provided in other sections of a papermaking machine if they are correspondingly adapted or additionally equipped with fiber plies, for example in order to form a fiber felt. They are also suitable, for example, as transport belts or filtering means.

Engineering fabrics made up of two or more independent fabric plies create the possibility of adapting the fabric plies to the particular requirements by selecting the nature, number, thickness, and material of the structural yarns. For example, when such fabrics are used in the papermaking machine sector it is common to manufacture the fabric ply that is intended to support the paper web from fine structural yarns having a weave pattern such that good fiber and filler retention is achieved and marking of the paper web, which is still very sensitive in this region, is prevented, but at the same time so that dewatering is also not substantially impeded. For the machine-side fabric ply it is usual to use a smaller number of structural yarns that have a larger diameter, in order to ensure good abrasion resistance and dimensional stability for the overall structure, i.e. to prevent longitudinal extensions and/or transverse shrinkage under load. Fine-yarn and coarse-yarn fabric plies of this kind can also be of multiple-ply configuration.

A problem that exists with such engineering fabrics, also called composite fabrics, is that of joining the fabric plies to one another. Two fundamentally different joining techniques have been developed in this context.

In the first joining technique, additional binding yarns that bind into two adjacent fabric plies are used. They do not belong the regular fabric weave of either the one fabric ply or the other fabric ply, i.e. do not constitute structural yarns. The binding yarns can run in either the warp or the weft direction (cf. U.S. Pat. No. 4,987,929; U.S. Pat. No. 5,518,042; U.S. Pat. No. 5,709,250; EP-B-0 579 818; U.S. Pat. No. 4,815,499; U.S. Pat. No. 4,729,412, FIG. 1). DE-A-42 29 828 and EP-A-0 408 849 also depict and describe binding yarns running in one direction; EP-A-0 408 849 showing a paired arrangement of two binding yarns in each case, which respectively alternate in the fabric plies that are joined by them. Casual mention is made of the possibility of providing binding yarns in both the longitudinal and the transverse direction, but such an arrangement is not explained or shown in further detail. Intersecting binding yarns of this kind are, however, explicitly evident from DE-A-34 11 119 and DE-C-33 01 810. In both cases, the binding yarns join the fabric plies not directly, but indirectly by forming an elastic intermediate layer, between the fabric plies, that is made up exclusively of the two binding yarn systems.

The joining technique described above has the disadvantage that yarns foreign to the structure are woven into the fabric as binding yarns. They engage irregularly into the binding weave and disrupt its uniformity, even if they are arranged respectively in pairs (cf. U.S. Pat. No. 4,987,929; U.S. Pat. No. 5,518,042; U.S. Pat. No. 5,709,250; EPA-0 408 849). This results in inhomogeneities in water removal and markings due to denting (dimpling effect) in the paper-side surface. In order to minimize these effects, relatively thin binding yarns are used. But because the binding yarns are subjected to large forces and moreover to abrasion due to mutual displacement of the fabric plies, a compromise must be found in this regard. This also applies to the number of binding yarns, since too large a number of such yarns would interfere with dewatering.

With the second type of joining technique, the structural yarns of at least one fabric ply are employed to join the fabric plies. These are not additional yarns, but those that are an integral component of the respective fabric ply. Examples of this may be seen in U.S. Pat. No. 4,605,585, U.S. Pat. No. 5,244,543, U.S. Pat. No. 5,564,475, EP-B-0 224 276, U.S. Pat. No. 4,501,303, U.S. Pat. No. Re.35,777, and EP-A-0 794 283. In the four first-named documents, all the structural longitudinal yarns of the paper-carrying fabric ply bind into the ply located therebelow, in some cases in such a way that each two adjacent structural yarns in the paper-carrying fabric ply alternate (cf. U.S. Pat. No. 4,605,585; EP-B-0 224 276). In the fabric according to U.S. Pat. No. Re.35,777, the binding structural yarns run in the transverse direction.

The three last-named documents above describe fabrics in which only a portion of the structural yarns running in one direction form binding structural yarns, by the fact that they bind not only into the paper-carrying fabric ply but also into the machine-side fabric ply. In this context, two binding structural yarns run next to each other in each case, i.e. form a pair of structural yarns, the manner in which they bind in being such that they alternate in the two fabric plies, i.e. when the one binding structural yarn is binding into the first fabric ply, the second binding structural yarn is binding into the other fabric ply. The two binding structural yarns thus intersect within the fabric. The binding-in within the respective fabric ply is such that the portions of the pairs of binding structural yarns and non-joining structural yarns that bind thereinto yield a desired weave pattern.

This joining technique also has disadvantages. If too many or indeed all of the-structural yarns of a fabric layer are bound in as binding structural yarns, the result is a very uneven surface, at least on the outer side of that fabric ply. If only a few structural yarns are employed as binding structural yarns, the joining of the fabric layers is not strong enough, so that relative movements occur between the fabric plies. This in turn results in internal friction, which causes premature wear with the risk of delamination. In addition, the structural binding yarns are then so highly stressed in tension that here again denting results, with the risk that marking in the paper web may occur.

SUMMARY OF THE INVENTION

It is the object of the invention to configure a textile planar structure having at least two independent plies in such a way that on the one hand permanent joining of the plies with high dimensional stability can be achieved, but on the other hand a very homogeneous surface is obtained.

This object is achieved, according to the present invention, in that groups of respectively adjacent second structural yarns bind, as binding structural yarns, into at least two textile plies in such a way that in these groups, the binding structural yarns alternate in at least one textile ply when viewed in their extension direction. A group of binding structural yarns can comprise two, but also three or even more yarns.

The present invention is directed to a textile planar structure for paper machine cloths, transport belts or filtering means that has two or more plies, and structural yarns in both the machine and cross-machine directions that bind at least two plies together, and optionally, structural yarns which do not bind the plies together, but which cooperate with the binding structural yarns to form a uniform weave pattern. At least one ply has a group of adjacent structural yarns running in the same direction that alternate in their position within the planar structure, such that when one yarn binds one ply, another yarn in the same group binds another ply, and vice versa. When a binding structural yarn from an adjacently disposed group crosses from a first ply into an inter-ply space between the plies, another yarn from the same adjacently disposed group crosses from a second ply into the inter-ply space without the binding structural yarns laying under or over each other.

BRIEF DESCRIPTION OF THE DRAWINGS

FIG. 2(*b*) shows a longitudinal section through the paper machine fabric according to FIG. 1, in plane A—A, including a nonwoven ply.

DETAILED DESCRIPTION OF THE INVENTION

Figure 1:
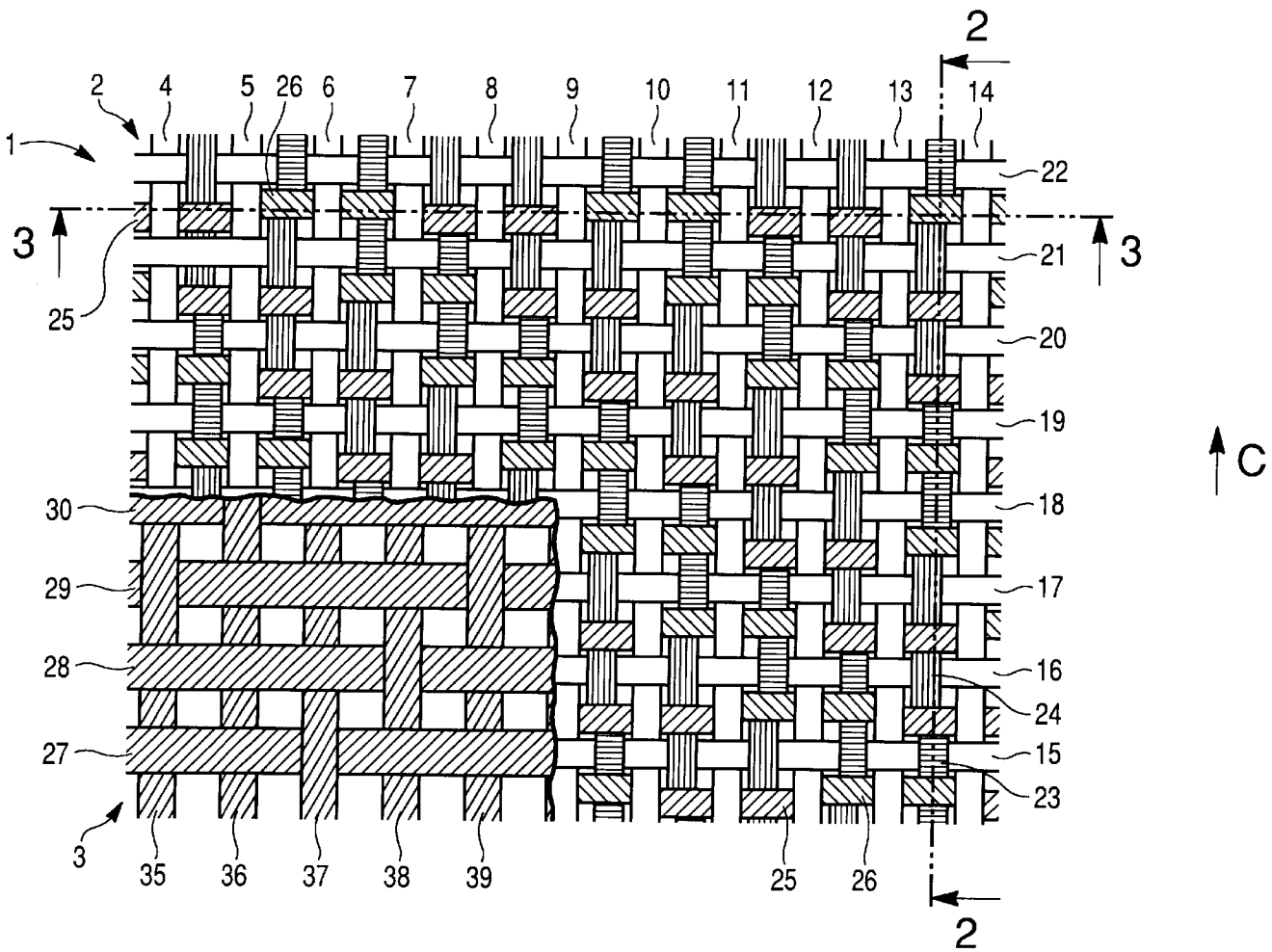
FIG. 1 shows a plan view of a portion of the upper ply of a papermaking machine fabric for the sheet-forming region of a papermaking machine, with a smaller portion showing the lower ply.

The basic idea of the invention is thus to provide groups of binding structural yarns in both directions. The binding-in of these binding structural yarns can, in each case, be limited to two adjacent textile plies. If more than two textile plies are present, however, the binding structural yarns can also bind more intro than two textile plies or even all the textile plies. In all cases, it thereby becomes possible to create a substantially greater number of attachment points between the textile plies, and thereby to distribute the forces on the textile plies more uniformly. This results in a more even surface, which is advantageous in particular for use in a papermaking machine because of the risk of marking that otherwise exists. The strength of the join can be selected, in accordance with the specific requirements, by way of material selection and the manner in which the binding structural yarns are bound in. In any event, relative movement between the textile plies can be greatly reduced by way of a stronger join. This in turn, because of the lower internal friction, results in a substantial lengthening of the service life. Dimensional stability is moreover good in both directions. Durability in response to cleaning with a high-pressure water stream is also improved.

It is further advantageous that because of the distribution of the attachment points in both directions, a substantially improved variability exists in terms of configuring the textile planar structure and the individual textile plies. The planar structure can be optimally adapted to the particular intended application. The requisite mechanical properties of the planar structure can be established largely irrespective of the other application-specific properties conditioned by its use, for example, as a paper machine cloth, filtering means, or the like. For example, in the case of an application as a sheet-forming wire, attention can be paid to good retention and water removal, without thereby needing to accept strength disadvantages.

In an embodiment of the invention, provision is made for the binding structural yarns to alternate in each group, viewed in their extension direction, in the textile plies that they join. All the binding structural yarns are therefore employed to join the textile plies, specifically in such a way that they alternate in all the textile plies.

In a further embodiment of the invention, provision is made for the groups of binding structural yarns extending in one direction to alternate with non-joining structural yarns extending in that direction; a corresponding provision can also be made for the groups of binding structural yarns extending in the other direction. The number of non-joining structural yarns between two groups of binding structural yarns can be adapted to the respective requirements, especially in terms of the strength with which the textile plies are joined, i.e. one or more non-joining structural yarns can be present. It also possible for several groups of binding structural yarns, extending in one direction, to run adjacent to one another. An odd number of binding structural yarns can also be present between two non-joining structural yarns, only a portion of those binding structural yarns constituting a group in the sense described above, i.e. alternating in one fabric ply.

Also belonging to the invention is an embodiment in which the fabric ply or at least one of the fabric plies has, in one direction, exclusively binding structural yarns i.e. no non-joining structural yarns are present in that direction. This allows the manufacturing outlay to be reduced.

According to a further feature of the invention, provision is made for the non-joining structural yarns not to be interwoven with one another in their fabric ply, i.e. for binding into the fabric ply to be accomplished via the binding structural yarns. If the binding structural yarns are omitted, the non-joining structural yarns are present only as a yarn layer. The same can also apply, conversely, to the binding structural yarns, i.e. notional omission of the non-joining structural yarns means that then, again, only one yarn layer remains.

In a preferred embodiment, in the or the at least one fabric ply, the portions of the binding structural yarns and of the non-joining structural yarns binding in there yield a uniform and conforming weave pattern. This is to be understood as a binding-in of the binding structural yarns (constituting a group) that corresponds in the relevant fabric ply to a continuous structural yarn that, together with the weave pattern of the non-joining structural yarns, yields a homogeneous fabric appearance. This has the advantage that the relevant surface of the fabric is of correspondingly homogeneous structure, i.e. it is difficult to detect that in a plane perpendicular to the surface, two or more binding structural yarns alternate, so that in plan view, the impression is given of a single, continuous structural yarn bound in conformingly with the weave. If as smooth as possible a surface is desired, for example on the paper-carrying side of a paper machine cloth or a filter sieve, it is understandable that this type of weave pattern should be effected as the fabric on at least one outer side.

With the textile planar structure according to the present invention, in known fashion all the textile plies can be configured as fabric plies. The possibility also exists, however, of configuring a portion of the textile plies as nonwoven yarn structures, in particular as yarn layers with intersecting structural yarns.

The basic idea of the invention is moreover not limited to specific weaves. All weaves that can be produced for engineering fabrics are possible, for example plain weave, satin weave, twill weave, etc. It is specifically an advantage of the fabric according to the present invention that because of the plurality of attachment points between the textile plies, there is inherently a great deal of freedom for configuring the individual textile plies, especially in terms of weaves.

There are also no limitations in terms of the geometry of the yarns, i.e. structural yarns with round, rectangular, oval, etc. cross sections are possible. It is also not a violation of the basic idea of the invention to use for the binding structural yarns cross-sectional geometries and cross-sectional areas different from those for the non-joining structural yarns. There is also no obstacle to providing a number of attachment points in the one direction which differs from the number in the other direction. The number of structural yarns in the one and the other direction—separately for each fabric ply—can be adapted in accordance with the particular requirements.

It is further understood that the widest variety of structural yarns can be used, for example monofilaments, multifilaments, fiber yarns, etc. They can also be combined with one another in order to bring out the respective dominant properties.

This also applies in similar fashion to the selection of the materials of the structural yarns. The materials possible in this case are all those that have been proposed for yarns in paper machine cloths, conveyor belts, or filter sieves, i.e. thermoplastic yarns in particular. Here again the basic idea of the invention allows every opportunity to discover the material suitable for the particular purpose; different materials can also be combined with one another, for example in such a way that high-strength, low-elongation material is used for the binding structural yarns because of their tensile load, while for the other structural yarns, a material adapted to their specific purpose is used.

The invention is illustrated, with reference to an exemplary embodiment, in the drawings, in which:

Papermaking machine fabric 1 depicted in Figures comprises an upper fabric ply 2 and a lower fabric ply 3.

The portion that shows upper fabric ply 2 depicts longitudinal structural yarns 4–14 that extend in the machine direction (arrow C), i.e. in a direction in which papermaking machine fabric 1 circulates after installation in the papermaking machine. Transverse structural yarns 4–14 extend transversely to longitudinal structural yarns 15–22, specifically over the entire width of papermaking machine fabric 1, only a portion of which is depicted here. Longitudinal structural yarns 4–14 and transverse structural yarns 15–22 are bound exclusively into upper fabric ply 2.

Extending between each two longitudinal structural yarns 4–14 are groups of longitudinal binding structural yarns, all designated in exemplary fashion in FIG. 1 as 23, 24, each group comprising a pair of two longitudinal binding structural yarns 23, 24. Running analogously between each two transverse structural yarns 15–22 are two transverse structural yarns, forming a group or pair and all designated in exemplary fashion as 25, 26. Longitudinal binding structural yarns 23, 24 and transverse binding structural yarns 25, 26 bind both into upper fabric ply 2 and into lower fabric ply 3. The binding into upper fabric ply 2 is such that longitudinal structural yarns 4–14 and transverse structural yarns 15–22 are present only as a yarn layer if longitudinal binding structural yarns 23, 24 and transverse binding structural yarns 25, 26 are notionally removed. This also applies, conversely, to longitudinal binding structural yarns 23, 24 and transverse binding structural yarns 25, 26, i.e. they too form only one yarn layer if longitudinal structural yarns 4–14 and transverse structural yarns 15–22 are notionally omitted.

In the portion that shows lower fabric ply 3, upper fabric ply 2 is not drawn in so that lower fabric ply 3 is visible. Longitudinal and transverse structural yarns 23, 24, 25, 26 are also omitted. Lower fabric ply 3 also comprises transverse structural yarns—labeled 27–30 in FIG. 1—and longitudinal structural yarns—labeled 35–39 in FIG. 1.

Figure 2A:
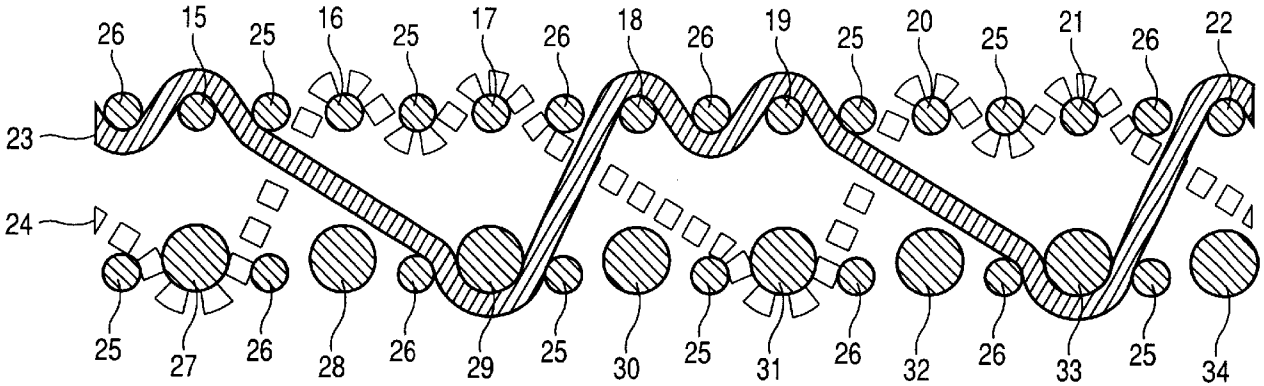
FIG. 2(*a*) shows a longitudinal section through the papermaking machine fabric according to FIG. 1, in plane A—A.

FIG. 2*a* shows the layout of a pair of longitudinal binding structural yarns 23, 24 in plane A—A as shown in FIG. 1. Otherwise all that is visible of fabric plies 2, 3 are transverse structural yarns 15–22 of upper ply 2 and transverse structural yarns 27–34 of lower fabric ply 3, as well as the pairs of transverse binding structural yarns 25, 26 running substantially one above another, whereas longitudinal structural yarns 4–14 are omitted. The front longitudinal binding structural yarn 23 (shown as a solid line) binds in respectively in upper fabric ply 2 with two transverse structural yarns 15–22 at the top and, in each case between two transverse structural yarns 15–22, with one transverse binding structural yarn 26 at the bottom, before penetrating into the interior of the fabric and binding in with a transverse structural yarn 27–34 in lower fabric ply 3. It then passes again through the interior of the fabric to upper fabric ply 2, and there binds in again with two transverse structural yarns 15–22 and between them with one transverse binding structural yarn 26. Longitudinal binding structural yarn 24 located behind it (drawn as a dashed line) binds in the same fashion as longitudinal binding structural yarn 23, but offset in such a way that longitudinal binding structural yarn 24 binds into upper fabric ply when longitudinal binding structural yarn 23 is binding into lower fabric ply 3. Longitudinal binding structural yarns 23, 24 thus intersect in the interior of the fabric without being disposed parallel to each other. The portions of longitudinal binding structural yarns 23, 24 thus alternate regularly in the respective fabric plies 2, 3.

Figure 2B:
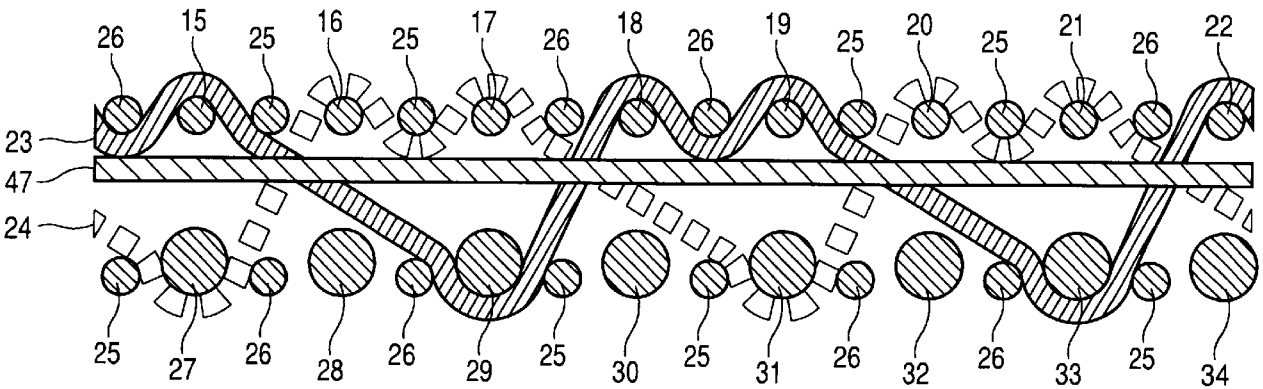

A portion of the textile plies may be configured as a nonwoven yarn structure or structures, in particular as a yarn layer with intersecting structural yarns. FIG. 2*b* shows that additional longitudinal yarns 47 and crosswise yarns 15–22 form a non-woven yarn layer of intersecting structural yarns. Manufacturing this layer is possible with usual textile measures similar to a weave.

The alternation occurs in the two fabric plies 2, 3 in such a way that in each fabric ply 2, 3, the respective portions of longitudinal binding structural yarns 23, 24 that are bound in there complement one another, specifically so that no overlaps of the portions and also no gaps between the portions occur. The juxtaposed layout of the portions corresponds to the layout of the adjacent longitudinal structural yarns 13, 14, but offset in the longitudinal direction in the manner of a plain weave. The portions of longitudinal binding structural yarns 23, 24 thus conform to the weave, as shown in FIG. 1. The fact that the portions are constituted by not one but two longitudinal binding structural yarns 23, 24 is evident in the plan view of FIG. 1 only from the slight transverse offsets of the portions, and is illustrated using different crosshatchings.

Figure 3:
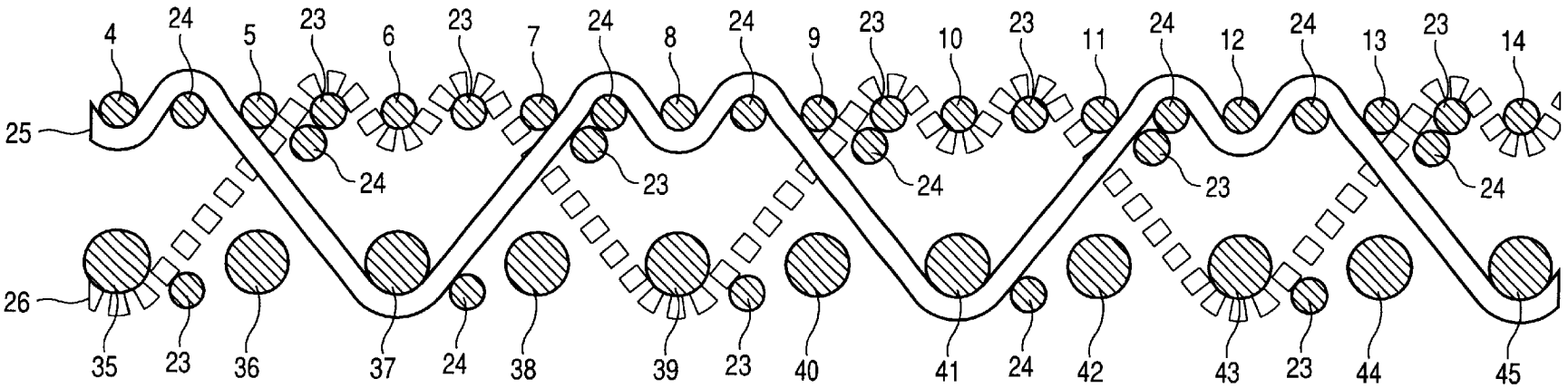
FIG. 3 shows a cross section through the paper machine fabric according to FIG. 1, in plane B—B.

In accordance with the plain-weave structure, the profile of transverse binding structural yarns 25, 26 does not differ from that of longitudinal binding structural yarns 23, 24, as is evident from FIG. 3. Here again, transverse binding structural yarn 25 located at the front alternates, between the two fabric plies 2, 3, with transverse binding structural yarn 26 located at the back, i.e. transverse binding structural yarns 25, 26, forming a pair, are located substantially one above another and intersect in the interior of the fabric. Each transverse binding structural yarn 25, 26 binds in with a longitudinal structural yarn 35–45 in lower fabric ply 3, and then passes through the interior of the fabric to upper fabric ply 2 where it binds in with two longitudinal structural yarns 4–14 and, between them, with one longitudinal binding structural yarn 23, 24. As in the case of longitudinal binding structural yarns 23, 24, the portions of transverse binding structural yarns 25, 26 complement one another in upper fabric ply 2 in such a way that the juxtaposed portions bind in with transverse structural yarns 15–22 in a manner that conforms to the weave, i.e. what results, in the plan view according to FIG. 1, is a fabric appearance like that of a plain weave. The fact that the portions are formed from two transverse binding structural yarns 25, 26 is apparent from the slight longitudinal offsets of the portions, illustrated by different crosshatchings.

What is claimed is:

1. A textile planar structure for paper machine cloths (1), transport belts, or filtering means, comprising at least two textile plies (2, 3) of which at least one textile ply is a fabric ply (2, 3) and having first structural yarns (4–14, 23, 24, 35–45) that run in one direction and second structural yarns (15–22, 25, 26, 27–34) that run transversely thereto, adjacent first structural yarns binding into said at least two textile plies (2, 3) wherein one of said first structural binding yarns binds said first ply and the other of said first structural binding yarns binds said second ply so that in at least one textile ply (2, 3) said first structural binding yarns alternate with one another without being disposed parallel when disposed between said plies when viewed in said one direction, and wherein adjacent second structural yarns bind (25, 26) into said at least two textile plies so that said second structural binding yarns (25, 26) alternate wherein when one of said second structural binding yarns (25, 26) binds said first ply another of said second structural binding yarns (25, 26) binds said second ply so that said second structural binding yarns (25, 26) alternate with one another without being disposed parallel when disposed between said plies when viewed in said transverse direction.

2. The planar structure as defined in claim 1, further comprising non-joining structural yarns (4–14), wherein groups of adjacent first binding structural yarns (23, 24) extending in said one direction alternate with said non-joining structural yarns (4–14) also extending in said one direction, when viewed in said one direction.

3. The planar structure as defined in claim 2, wherein groups of said second binding structural yarns (25, 26) extending in said transverse direction also alternate with non-joining structural yarns (15–22) extending in said transverse direction, when viewed in said transverse direction.

4. The planar structure as defined in claim 1, further comprising multiple non-joining structural yarns running adjacently to each other.

5. The planar structure as defined in claim 1, wherein multiple groups of said first binding structural yarns extending in said one direction run adjacently to one another, or multiple groups of said second binding structural yarns extending in said transverse direction run adjacently to one another.

6. The planar structure as defined in claim 1, wherein one of said at least two fabric plies has, in either said one direction or said transverse direction, exclusively binding structural yarns.

7. The planar structure as defined in claim 1, further comprising non-joining structural yarns (4–14, 15–22) that are not interwoven with one another in the fabric ply of said at least two fabric plies to which they belong.

8. The planar structure as defined in claim 1, wherein the binding structural yarns (23, 24, 25, 26) are not interwoven with one another in at least one of said at least two fabric plies.

9. The planar structure as defined in claim 1, wherein in said at least one fabric ply (2, 3) or in more than one said at least one fabric ply, portions of said binding structural yarns (23, 24, 25, 26) and of non-joining structural yarns (4–14, 15–22, 22–37, 38–48) binding in said at least one fabric ply or in said more than one said at least one fabric ply yield a uniform and conforming weave pattern.

10. The planar structure as defined in claim 9, wherein the non-joining structural yarns (4–14, 15–22, 27–37, 38–48) and the binding structural yarns (23, 24, 25, 26) form a uniform weave pattern on at least one outer side of the planar structure.

11. The planar structure as defined in claim 1, wherein all the textile plies are configured as fabric plies (2, 3).

12. The planar structure as defined in claim 1, wherein at least one textile ply is configured as a nonwoven textile ply, said nonwoven textile ply defined as a yarn layer with intersecting structural yarns.

13. A textile planar structure for paper machine cloths (1), transport belts, or filtering means, comprising:

at least two textile plies (2, 3) of which at least one textile ply is a fabric ply (2,3);

first structural yarns (4–14, 23, 24, 35–45) running in one direction, comprising first binding structural yarns and optional first structural non-binding yarns, said first binding structural yarns bind into said at least two textile plies;

second structural yarns (15–22, 25, 26, 27–34) running in a direction transverse to said one direction, comprising second binding structural yarns and optional second structural non-binding yarns, said second binding structural yarns bind into said at least two textile plies; and an axis running from a bottom of said planar structure to a top of said planar structure, wherein a group of adjacent first binding structural yarns alternates such that when one yarn of said group binds into one of said at least two textile plies, another yarn of said group binds into another of said at least two textile plies, and wherein when both said one yarn of said group and said another yarn of said group passes between said at least two plies, said one yarn of said group and said another yarn of said group are not disposed parallel to each other with respect to said axis.

14. The planar structure as defined in claim 13, wherein one of said at least two fabric plies has, in either said one direction or said transverse direction, exclusively binding structural yarns.

15. The planar structure as defined in claim 13, wherein the binding structural yarns (23, 24, 25, 26) are not interwoven with one another in at least one of said at least two fabric plies.

16. The planar structure as defined in claim 13, wherein in said at least one fabric ply (2, 3) or in more than one said at least one fabric ply, portions of said binding structural yarns (23, 24, 25, 26) and of non-binding structural yarns (4–14, 15–22, 22–37, 38–48) binding into said at least one fabric or in said more than one said at least one fabric ply, yield a uniform and conforming weave pattern.

17. The planar structure as defined in claim 16, wherein the non-binding structural yarns (4–14, 15–22, 27–37, 38–48) and the binding structural yarns (23, 24, 25, 26) form a uniform weave pattern an at least one outer side of said planar structure.

18. The planar structure as defined in claim 13, wherein in at least one of said textile plies has a uniform weave pattern of interwoven first binding structural yarns, first non-binding structural yarns, second binding structural yarns, and second non-binding structural yarns.

19. The planar structure of claim 13, wherein in at least one of said textile plies has a uniform weave pattern comprising pairs of adjacent said first binding structural yarns alternating with single said first non-binding structural yarns.

* * * * *